US008902027B2

(12) United States Patent
Ramirez et al.

(10) Patent No.: US 8,902,027 B2
(45) Date of Patent: Dec. 2, 2014

(54) ELECTRIC PROTECTION APPARATUS COMPRISING AT LEAST ONE BREAKING MODULE CONTROLLED BY A CONTROL DEVICE WITH ELECTROMAGNETIC COIL

(75) Inventors: Jean-Claude Ramirez, Saint Martin D'Uriage (FR); Benoît Hage, Voiron (FR); Jean-Yves Amblard, Le Gua (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 13/534,860

(22) Filed: Jun. 27, 2012

(65) Prior Publication Data

US 2012/0326814 A1 Dec. 27, 2012

(30) Foreign Application Priority Data

Jun. 27, 2011 (FR) ..... 11 01975

(51) Int. Cl.

| | |
|---|---|
| ***H01H 9/30*** | (2006.01) |
| ***H01H 9/34*** | (2006.01) |
| ***H01H 73/18*** | (2006.01) |
| ***H01H 71/10*** | (2006.01) |
| *H01H 71/02* | (2006.01) |

(52) U.S. Cl.

CPC ..... *H01H 73/18* (2013.01); *H01H 9/34* (2013.01); *H01H 2071/0278* (2013.01); *H01H 71/0271* (2013.01); *H01H 2009/305* (2013.01); *H01H 71/1045* (2013.01)

USPC ..... 335/201; 335/8

(58) Field of Classification Search

CPC ..... H01H 50/546; H01H 2009/305; H01H 2071/0278; H01H 9/342; H01H 9/345; H01H 73/18; H01F 2007/083

USPC ..... 335/8–19, 2, 201, 202

See application file for complete search history.

(56) References Cited

U.S. PATENT DOCUMENTS

| | | | | |
|---|---|---|---|---|
| 5,892,194 | A * | 4/1999 | Uotome et al. | 218/68 |
| 6,278,605 | B1 * | 8/2001 | Hill | 361/600 |
| 6,545,574 | B1 * | 4/2003 | Seymour et al. | 335/18 |
| 7,586,395 | B2 * | 9/2009 | Weister et al. | 335/172 |
| 2006/0274459 | A1 * | 12/2006 | Zhou et al. | 361/23 |
| 2007/0232144 | A1 | 10/2007 | Carlino et al. | |
| 2008/0074215 | A1 * | 3/2008 | Zhou et al. | 335/132 |

FOREIGN PATENT DOCUMENTS

| | | | |
|---|---|---|---|
| EP | 0508846 | A1 | 10/1992 |
| EP | 1209712 | A1 | 5/2002 |

* cited by examiner

*Primary Examiner* — Bernard Rojas
(74) *Attorney, Agent, or Firm* — Steptoe & Johnson LLP

(57) ABSTRACT

The present invention relates to an electric protection apparatus comprising at least one switching module fitted on a mounting support, and a control device with an electromagnetic coil juxtaposed with one of the above-mentioned modules, this device comprising a magnetic shield arranged in a plane substantially perpendicular to the plane of the mounting support, said shield being located between the control device and the switching module situated closer to said device, facing the coil of the control device, and comprising at least one ferromagnetic part shaped in such a way that said shield performs magnetic guiding of the arc as soon as separation of the contacts takes place so as to increase the propulsion component of the Laplacian force acting on the arc as soon as separation of the contacts takes place.

10 Claims, 9 Drawing Sheets

Figure 1:
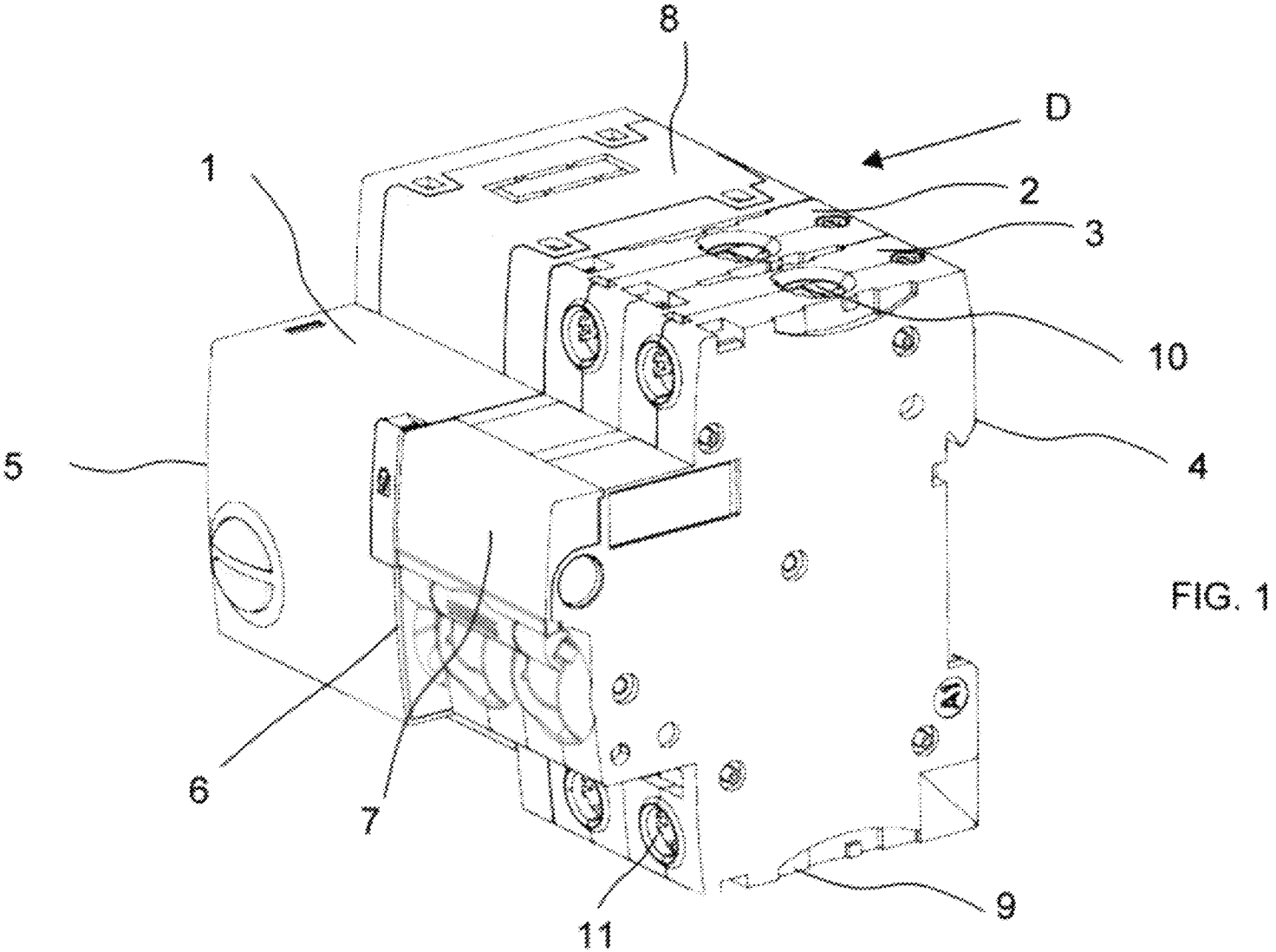

ELECTRIC PROTECTION APPARATUS COMPRISING AT LEAST ONE BREAKING MODULE CONTROLLED BY A CONTROL DEVICE WITH ELECTROMAGNETIC COIL

The present invention relates to an electric protection apparatus comprising at least one switching module fitted on a mounting support, and a control device with an electromagnetic coil juxtaposed with one of the above-mentioned modules, each switching module comprising two contacts one of which is movable with respect to the other between a first position in which the contacts are closed and enable the current to flow and an open position in which the current is interrupted between the contacts, and the above-mentioned control device comprising an electromagnetic coil designed to command opening or closing of the contacts, the coil of the control device being located substantially facing the contact point(s) of the contacts of the switching module(s), the axis called first axis of the coil of the control device extending substantially perpendicularly to the fixing plane whereas the axis (axes) of the switching module(s) extend(s) substantially parallel to the fixing plane, the axis called first axis extending substantially perpendicularly to the axis (axes) called second axis (axes).

Electric protection apparatuses such as low-voltage circuit breakers enable the electric current in an electric circuit to be interrupted in a manner known as such by separation of the contacts so as to protect property and persons against the effects of short-circuit currents.

The present invention more particularly concerns the field of protective circuit breakers of ultra-terminal type associated with electromagnetic auxiliaries controlling opening and closing.

In such apparatuses, the electric arc arising on separation of the contacts is subjected to the Laplacian force which tends to direct it to the pre-chamber. Associating a control auxiliary with an electromagnetic coil with a two-pole circuit breaker has the effect of disturbing departure of the arc.

This disturbance results both in a loss of the component of the propulsion force of the arcs, and a very large increase of the lateral component of the Laplacian force. This effect is more particularly visible on the arc situated closer to the auxiliary. This problem arises more particularly during electric endurance testing for very weak test currents.

After a certain number of cycles, it is observed that the side walls can be burned and destroyed resulting in problems of malfunctioning of the thermal trip device and risks of pollution of the contact area.

A thoroughgoing examination shows that there is a privileged side where this destruction occurs, which leads to suppose that the Laplacian force is deviated laterally.

The investigations carried out show the complexity of the impact on arc departure and the interactivity of the set of components constituting the circuit breaker, in particular the strong electromagnetic impact of the remote control coil.

The remote control impairs breaking and electric endurance by the electromagnetic field created by its coil.

The present invention solves these problems and proposes an electric protection apparatus of simple design wherein the breaking characteristics are improved, in particular by an increase of the component of the propulsion force acting on the arc when breaking takes place.

For this purpose, the object of the present invention is to provide an electric protection apparatus of the above-mentioned kind, this apparatus being characterized in that it comprises a magnetic shield arranged in a plane substantially perpendicular to the plane of the mounting support, said shield being situated between the control device and the switching module located closer to said device, facing the coil of the control device, and comprising at least one ferromagnetic part shaped in such a way that said shield performs magnetic guiding of the arc as soon as separation of the contacts takes place so as to increase the propulsion component of the Laplacian force acting on the arc as soon as separation of the contacts takes place.

According to a particular feature, the coil of the control device, seen from the front of the apparatus, is wound in an opposite direction of winding to the direction of winding of the coil(s) of the switching module(s), the latter direction of winding being seen from the top part of the apparatus.

The direction of winding of the coil of the control device is the counterclockwise direction, whereas the coil(s) of the switching module(s) is(are) wound in a clockwise direction.

According to another feature, the above-mentioned shield presents the form of a cross comprising two wings called first wings extending in the heightwise direction of the apparatus and substantially perpendicularly to the longitudinal direction of the rail, and two wings called second wings extending in the longitudinal direction of the rail, the part comprising these second wings and the above-mentioned central part joining these two wings being situated substantially facing the coil of the control device so as to cover the latter substantially completely.

According to another feature, the above-mentioned shield presents a thickness comprised between 0.5 and 1.2 mm.

According to another feature, the magnetic shield is positioned sandwiched between the enclosure of the control device and that of the adjacent switching module.

According to another feature, this apparatus comprises pre-positioning means of said shield with respect to the case of the control device or to the case of the switching module, these means comprising two centring pins provided on one of the cases operating in conjunction with holes provided on the other of the cases, or a peripheral rib made on one of the cases.

According to another feature, this electric protection apparatus is a low-voltage circuit breaker.

According to another feature, this control device is a remote control device.

According to another feature, this apparatus is a two-pole low-voltage circuit breaker comprising two switching modules.

Figure 2:
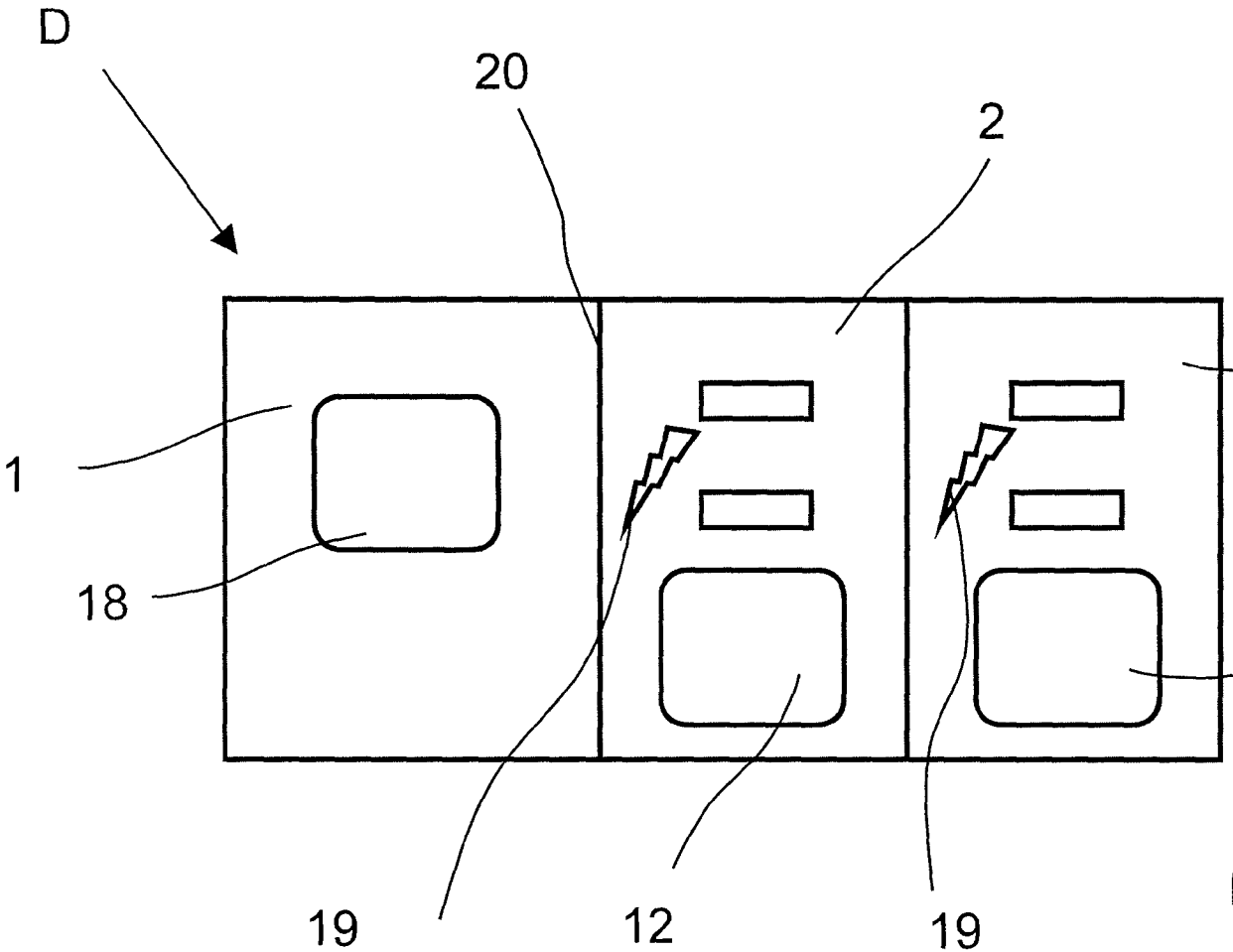
FIG. 2 PRIOR ART
Figure 3:
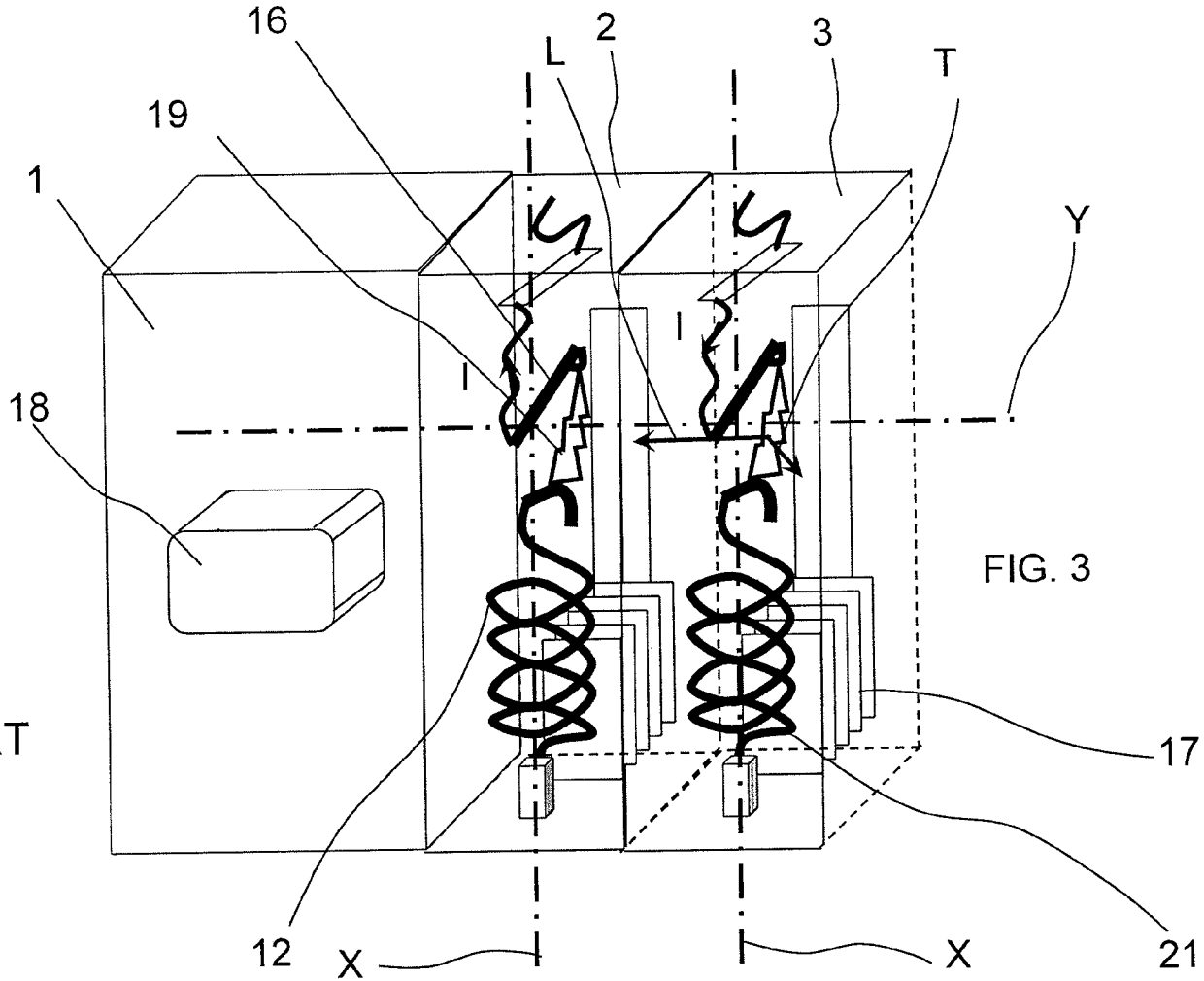
FIG. 3 PRIOR ART
Figure 4:
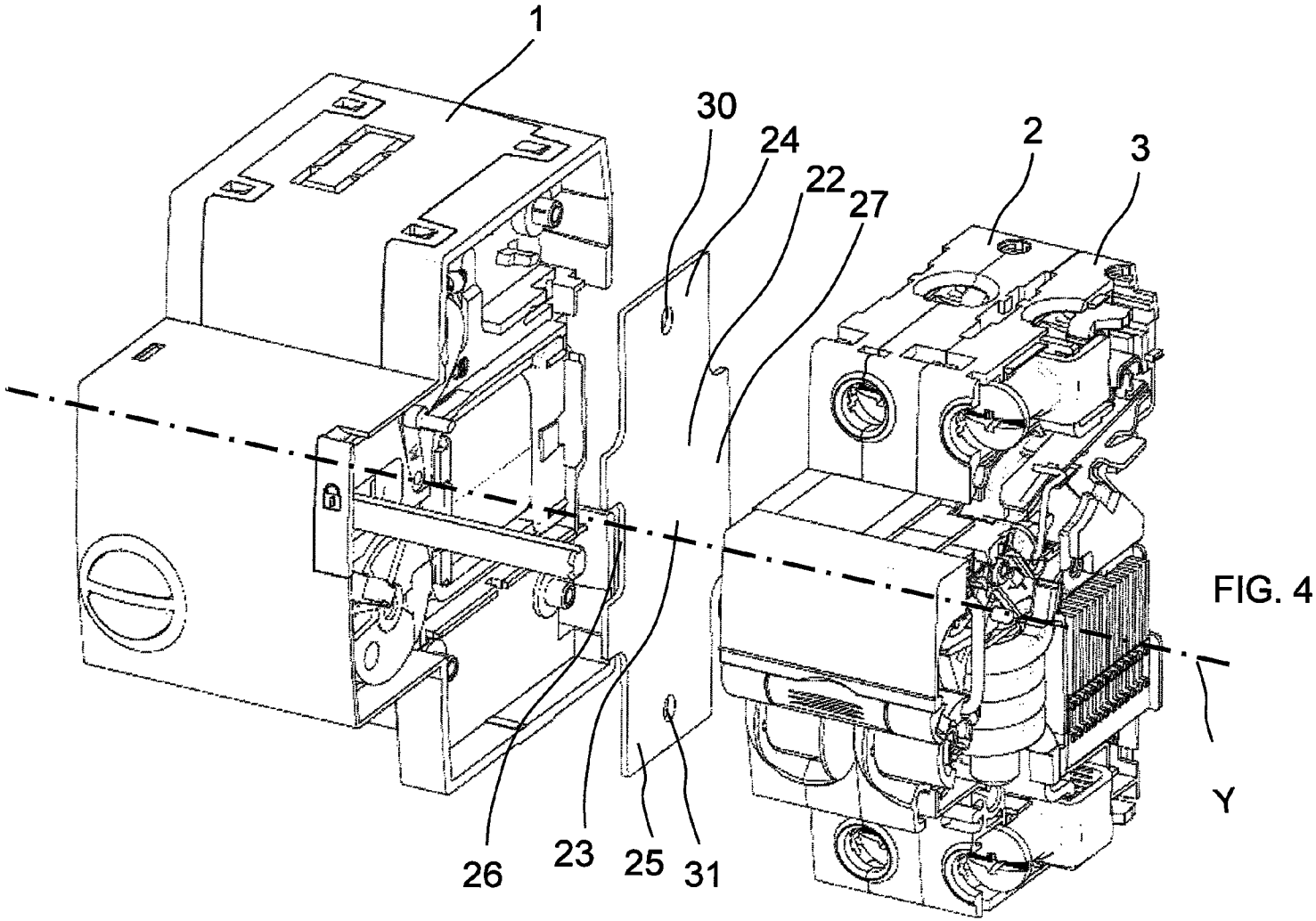
Figure 5:
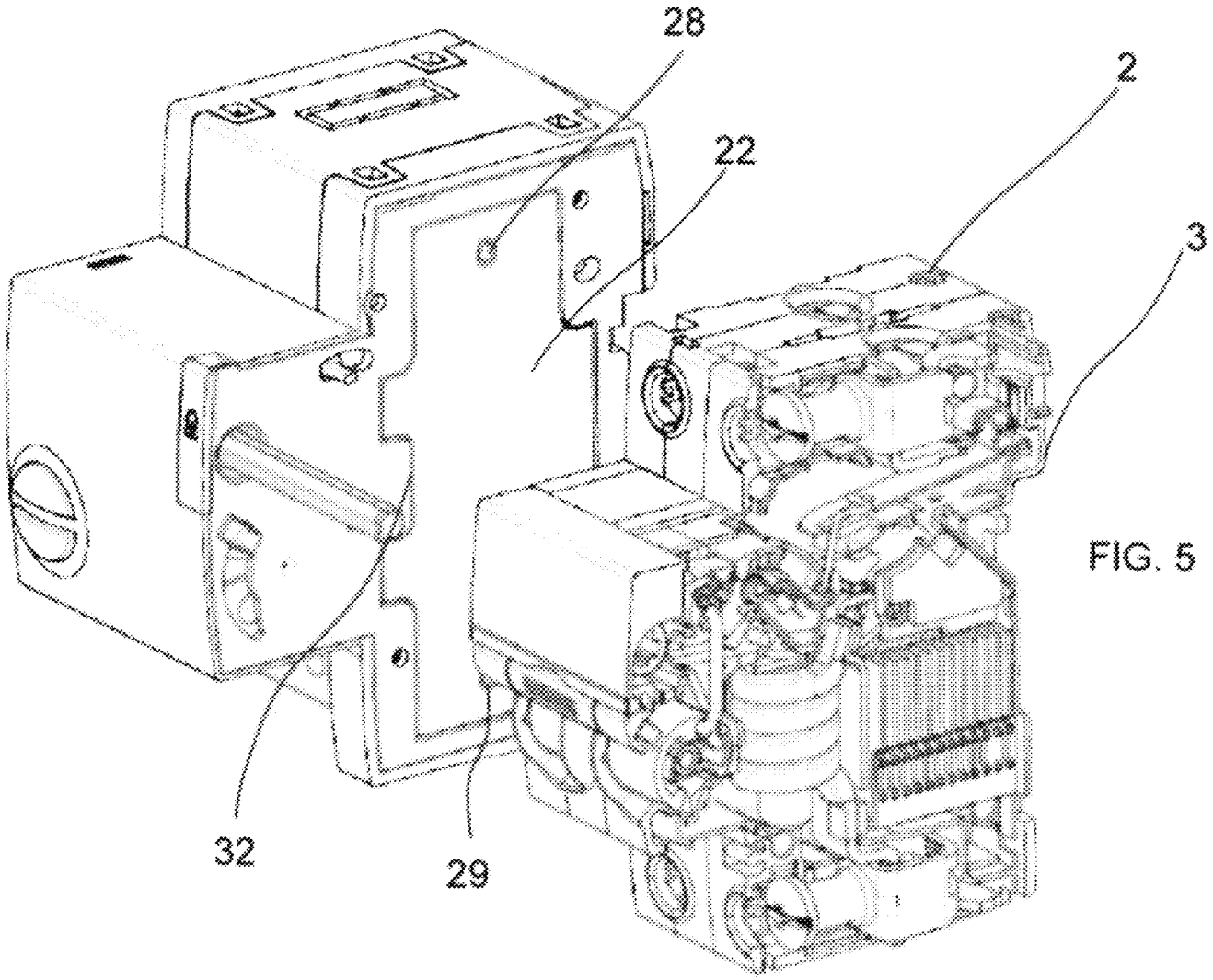
Figure 6:
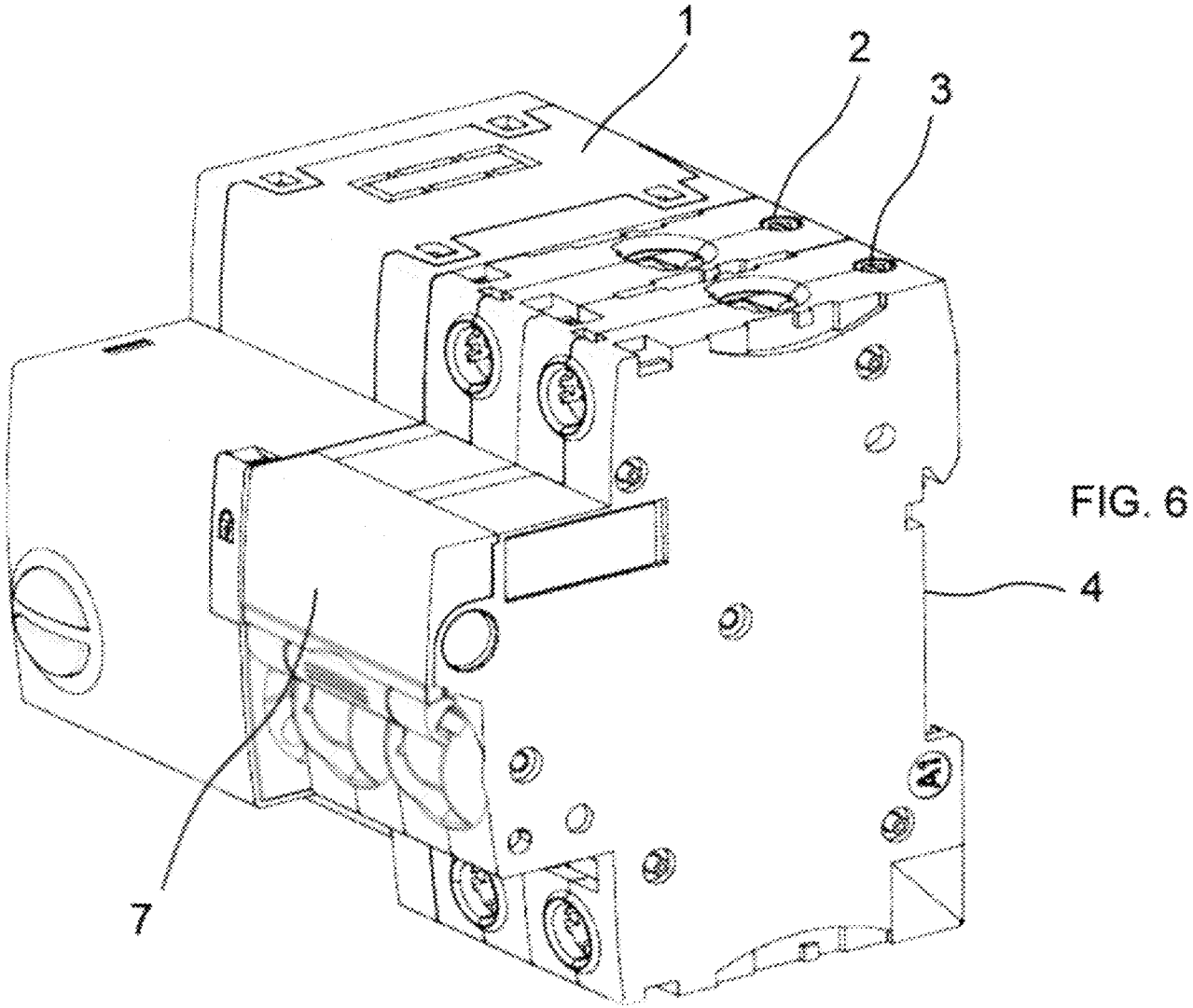
Figure 7:
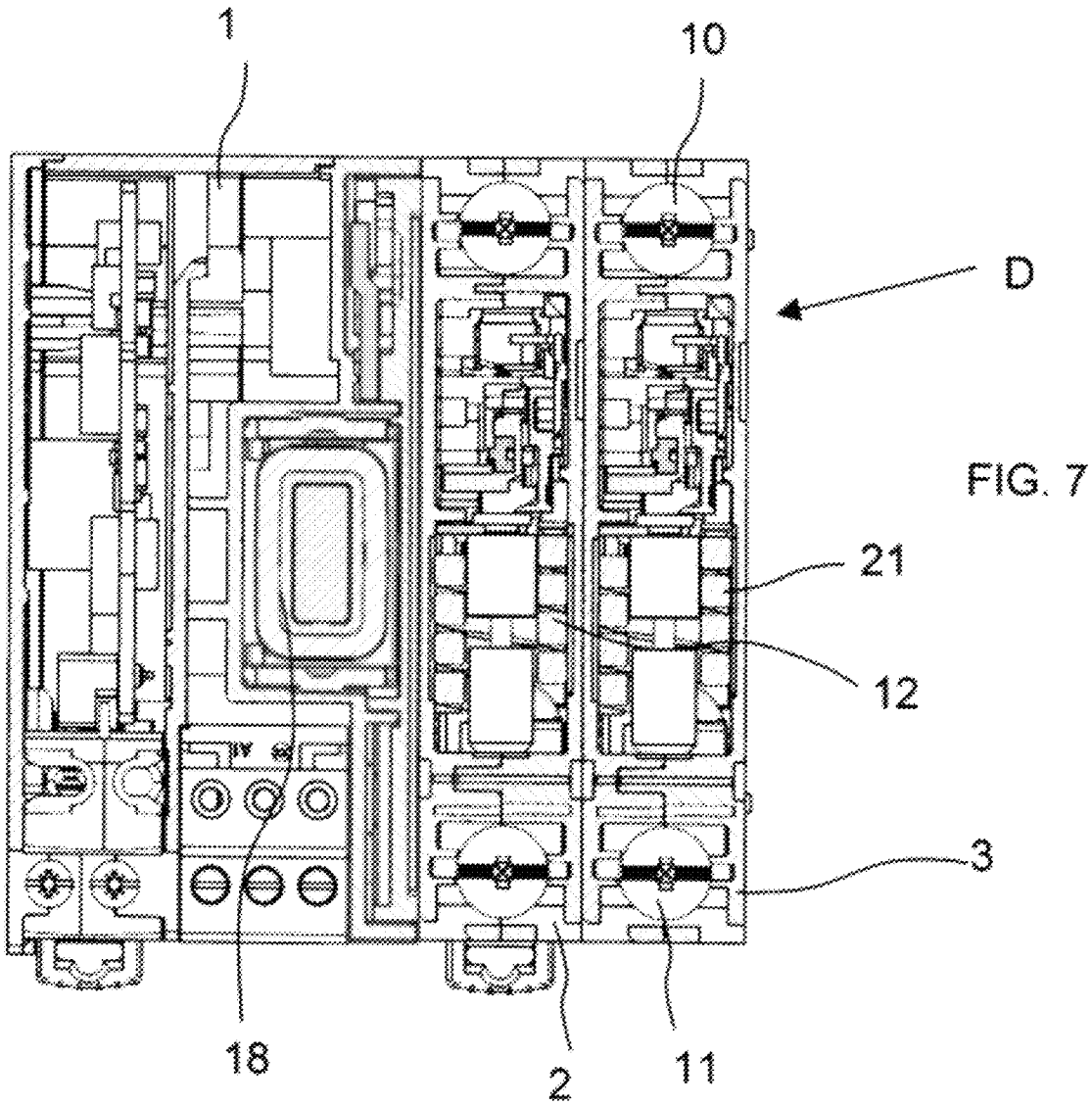
Figure 8:
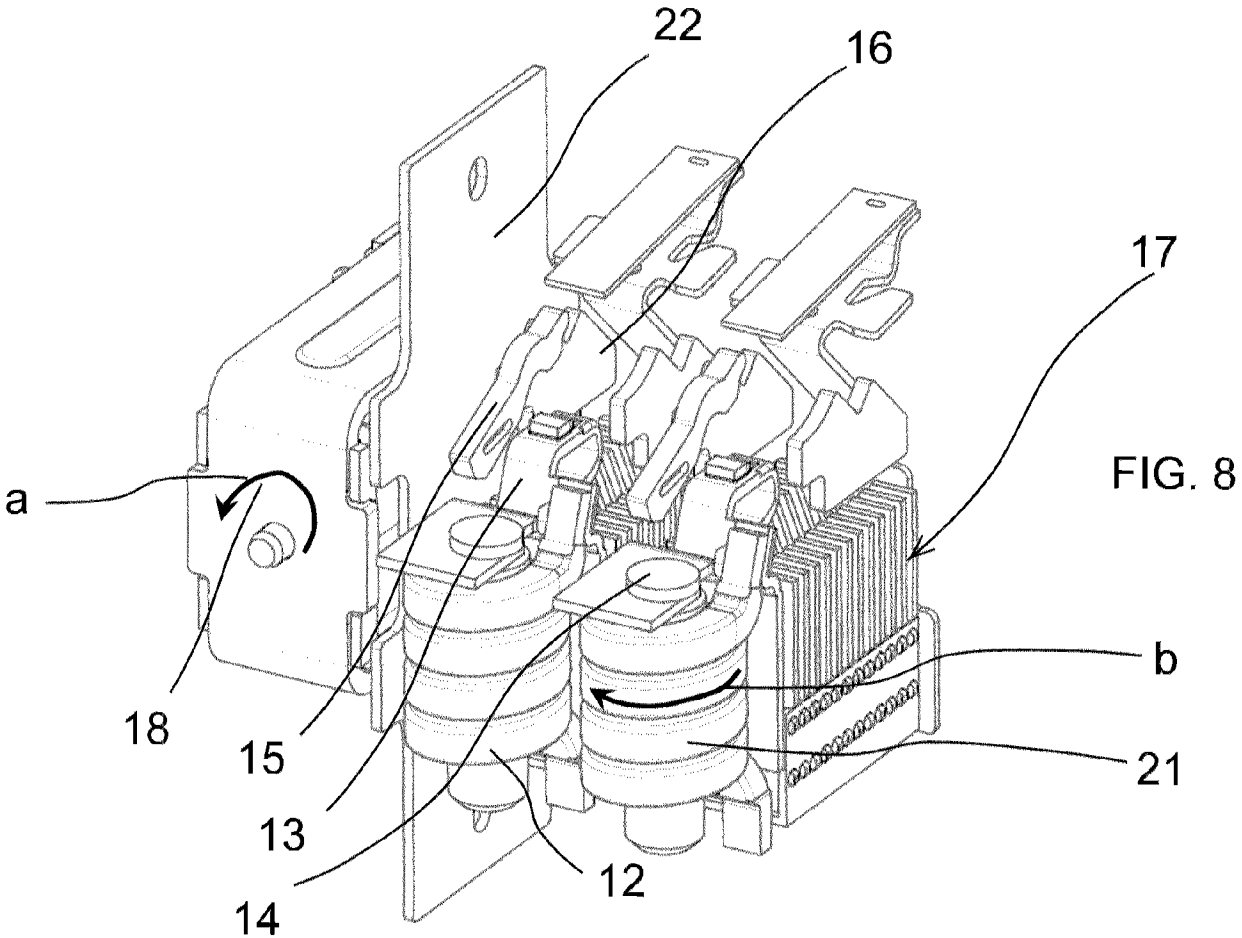
Figure 9:
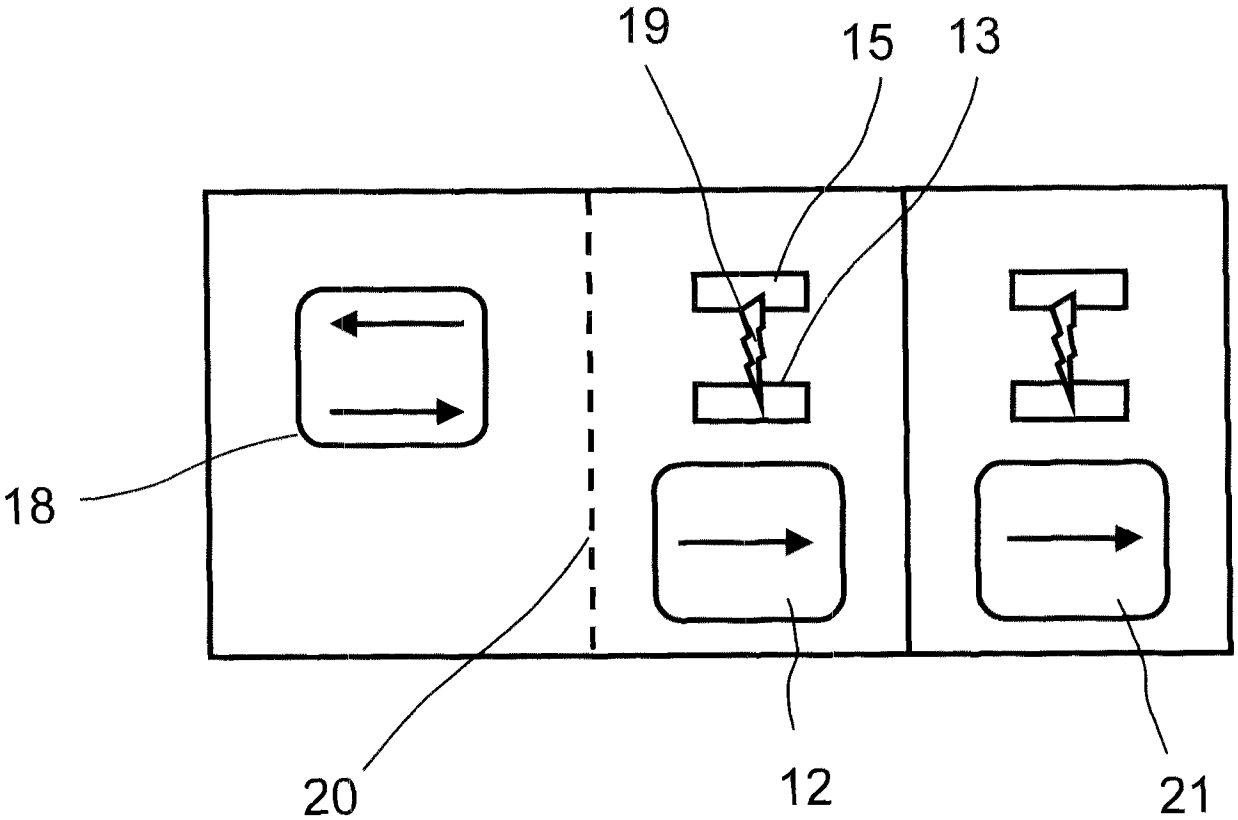

But other advantages and features of the invention will become more clearly apparent from the following detailed description which refers to the appended drawings given for example purposes only and in which:

FIG. 1 is a perspective view of a two-pole electric protection circuit breaker associated with an electromagnetic auxiliary controlling opening and closing of the contacts of said circuit breaker, according to the invention, FIG. 2 is a schematic front view illustrating, for a circuit breaker according to the prior art of the same type as that of FIG. 1, the electromagnetic coils of an auxiliary control device and of the switching modules, as well as the path of the electric arc when separation of the contacts takes place, FIG. 3 is a perspective view illustrating the innards of a circuit breaker according to FIG. 2 in schematic manner, FIG. 4 is a perspective view illustrating from left to right, an auxiliary control device, a magnetic guide and switching modules, FIG. 5 is a similar view to FIG. 4, after the magnetic guide has been fitted on the circuit breaker, and FIG. 6 is a perspective view illustrating the circuit breaker according to the invention after the switching modules have been fitted onto the circuit breaker, FIG. 7 is a cross-sectional view of the above-mentioned circuit breaker according to the invention, in a plane parallel to the plane of the mounting support, FIG. 8 is a partial perspective view illustrating the coil of the auxiliary control device, the magnetic guide according to the invention, and the switching modules, and FIG. 9 is a similar view to FIG. 2, illustrating the electric arc in the case of a circuit breaker according to the invention.

In FIG. 1, a modular two-pole low-voltage electric circuit breaker D according to the invention can be seen comprising, from left to right, a remote control device 1 and two switching modules 2,3, the device and modules being housed in modular cases designed to be fitted side-by-side on a mounting rail (not shown). Each case comprises a rear panel 4 for fixing to the rail, two main panels 5,6 via which the cases are adjoined two by two, a front panel 7 forming a nose, a top panel 8 and a bottom panel 9, said panels comprising input terminals 10 and output terminals 11 of the apparatus.

In a manner known as such, each switching module 2,3 comprises a magnetic trip device designed to command opening of the contacts in the case of a short-circuit in the circuit to be protected, and a thermal trip device designed to cause opening of the contacts in the case of an overload in the circuit.

As illustrated more particularly in FIG. 8, each magnetic trip device comprises a coil 12 through which the current to be monitored flows and which is electrically connected to the stationary contact 13, said coil having passing through it an actuating rod 14 designed to actuate the movable contact 15 in case of a short-circuit. The stationary contact 13 and a movable contact 15 are situated in a space 16 called pre-chamber in which the electric arc forms before being displaced to an arc chute 17.

The remote control device 1 mainly comprises an electromagnetic coil 18 designed to act on the contacts 13,15 so as to bring about opening or closing of the latter.

In FIG. 2, in a two-pole circuit breaker D associated with a control auxiliary 1 with an electromagnetic coil according to the prior art, the electric arc 19 on departure is delineated laterally as has been explained in the foregoing, which leads to a possible destruction of the side walls 20 of the corresponding case. In this embodiment also illustrated in FIG. 3, the lateral component L of the Laplacian force is very large compared with the propulsion component T.

As can be seen in FIGS. 3 and 7 to 9, the coils 12,21 of the switching modules 2,3 are substantially in the same plane parallel to the plane of the mounting support, the axis X of the coils of the switching modules 2,3 extending substantially perpendicular to the axis Y of the coil of the control device 1.

As illustrated in FIGS. 4 to 9, and according to the invention, a part 22 in the form of a plate made from ferromagnetic material presenting the general shape of a cross is fitted between the control device 1 and the closer switching module 2 which is associated with it. This part comprises a central part 23 from which there extend two wings 24,25 extending substantially perpendicularly to the longitudinal direction Y of the mounting support and two wings 26,27 extending in substantially parallel manner to this direction. This central part 23 and the two wings 26,27 extending in substantially parallel manner to the above-mentioned longitudinal direction Y are dimensioned so as to substantially completely cover the coil 18 of the control device 1.

As illustrated in FIG. 5, this part 22 is positioned sandwiched between the enclosures of the control device 1 and that of the switching modules 2,3.

Pre-positioning of the part is performed by means of two centring pins 28,29 provided on the circuit breaker enclosure designed to operate in conjunction with holes 30,31 provided on the plate 22. Another embodiment of this pre-positioning could consist in a peripheral rib provided on one or the other of the enclosures and designed to receive said plate 22.

This part is designed to constitute a magnetic guide for the arc and is kept in its definitive position by assembly of the control device 1 on the circuit breaker constituted by the two modules 2,3, as illustrated in FIGS. 6 and 7.

The presence of a notch 32, on the side of the plate 22, designed to enable passage of the fixing means of the coil 18 of the control device 1 can also be observed, as illustrated in FIG. 5.

The thickness of the plate must not be too great so that the latter does not constitute a shielding the function of which would be to stop the flux, but on the contrary performs the magnetic guiding function.

This thickness will therefore advantageously be comprised between 0.5 mm and 1.2 mm, with a preferred value of 1 mm.

Even if the foremost function of this plate is not to constitute a shielding, it can be noted that the cross shape of this plate will enhance the shielding of the latter.

Also according to the invention, the control coil 18 of the control device 1 is wound, in front view of the apparatuses, in a direction a opposite to the direction of winding b of the coils 12,21 of the switching modules 2,3, in top view of the latter.

The direction of winding of the circuit breakers usually being the clockwise direction seen in top view, the direction of winding of the control coil 18 of the control device 1 will therefore advantageously be the counterclockwise direction. See coil 18 in FIG. 7 and 8, and winding direction arrow "a" in FIG. 8.

In operation, when separation of the contacts 13,15 takes place, this magnetic guide formed by the above-mentioned plate 22 enables the magnetic flux lines to be channelled and creates more favourable conditions for arc departure, at the separation point of the contacts, enabling the latter to be rectified so as to recentre it as illustrated in FIG. 9.

The invention enables electromagnetic effects to be obtained consisting in a reduction of the lateral component L of the detrimental Laplacian force of about 75% on the arc of the switching module that is closer to the remote control coil. An increase of the propulsion component T is thus obtained for each of the arcs respectively produced by the different switching modules, this component even becoming greater than on a circuit breaker without an associated control device. This increase with respect to a circuit breaker without an auxiliary control device is 20% on the arc farther from the remote control device and about 2000% on the arc closer to the electromagnet. The auxiliary control device can then be considered as being a complementary arc blow-out device.

An electric protection apparatus wherein an associated control device no longer impairs breaking of the switching modules with which it is associated, or the endurance by the electric field created by its coil, has therefore been achieved according to the invention. The surfaces of the side walls of the switching modules are no longer damaged.

These results are obtained by means of a solution which consists in associating a magnetic guide of small thickness with a particular winding convention of the coil of the control device and of the coils of the pole-unit actuators.

The invention applies particularly to electric switchgear apparatuses such as circuit breakers controlled by a control device comprising an electromagnetic coil such as a remote control or a differential detection device, and in broader manner to any actuator equipped with auxiliaries with an electromagnetic control coil.

The invention is naturally in no way limited to the embodiments described and illustrated which have been given for example purposes only.

The shield can thus be formed by one or more parts made from a ferromagnetic material positioned in a vertical plane between the electromagnet and the closer switching module.

On the contrary, the invention extends to encompass all the technical equivalents of the described means as well as combinations thereof if the latter are performed according to the spirit of the invention.

The invention claimed is:

1. An electric protection apparatus comprising at least one switching module and a control device having an electromagnetic coil located adjacent, side-by-side, said switching module, said switching module comprising a switching coil, and two contacts one of which is movable with respect to the other between a first position in which the contacts are closed and enable current to flow and an open position in which the current is interrupted between the contacts, the electromagnetic coil of the control device for commanding opening or closing of the contacts, the coil of the control device being located substantially facing the contacts of the switching module, the coil of the control device having a first axis extending in a Z direction, substantially perpendicular to a fixing plane, the switching coil of the switching module having a second axis extending in a Y direction substantially parallel to the fixing plane, the first axis extending substantially perpendicular to the second axis, a planar magnetic shield located between the control device and the switching module, closer to said control device and facing the coil of the control device, and comprising at least one ferromagnetic part dimensioned so that it covers the coil of said control device, said part for magnetic guiding of an arc to increase the propulsion component of the Laplacian force acting on the arc as soon as separation of the contacts takes place.

2. The electric protection apparatus according to claim 1, wherein the coil of the control device, as seen from the front of the apparatus, is wound in an opposite direction of winding to the direction of winding of the switching coil of the switching module, as seen from the top of the apparatus.

3. The electric protection apparatus according to claim 1, wherein the direction of winding of the coil of the control device is the counterclockwise direction, whereas the switching coil of the switching module is wound in a clockwise direction.

4. The electric protection apparatus according to claim 1, wherein the planar magnetic shield comprises a shape of a cross comprising, first wings extending in the X direction substantially perpendicular to the Y direction, and two second wings extending in the Z direction which is substantially perpendicular to the X and Y directions, the part comprising the second wings facing the coil of the control device to cover that coil substantially completely.

5. The electric protection apparatus according to claim 1, wherein the planar magnetic shield is of a thickness between 0.5 and 1.2 mm.

6. The electric protection apparatus according to claim 1, wherein the planar magnetic shield is positioned between an enclosure of the control device and an enclosure of the adjacent switching module.

7. The electric protection apparatus according to claim 6, additionally comprising means for pre-positioning said planar magnetic shield with respect to the enclosure of the control device or of the switching module, said pre-positioning means comprising two centering pins attached to one of the enclosures, and holes in the other enclosure, or in a peripheral rib on one of the enclosures.

8. A low-voltage electric protection and breaker apparatus according to claim 1.

9. The electric protection apparatus according to claim 1, wherein the control device is a remote control device.

10. A low-voltage electric protection and breaker apparatus according to claim 8, comprising a two-pole low-voltage circuit breaker comprising two switching modules.

* * * * *